United States Patent [19]

Melnikov

[11] 4,030,629

[45] June 21, 1977

[54] FLEXIBLE HATCH COVER

[75] Inventor: Igor V. Melnikov, East Brunswick, N.J.

[73] Assignee: Kimberly-Clark Corporation, Neenah, Wis.

[22] Filed: June 28, 1976

[21] Appl. No.: 700,458

[52] U.S. Cl. ..... 220/211; 220/287; 251/212

[51] Int. Cl.[2] ..... B65D 55/00

[58] Field of Search ..... 220/211, 287, 288; 215/319; 251/212; 137/242, 545

[56] References Cited

UNITED STATES PATENTS 3,329,396 7/1967 Heaton ..... 251/212

3,787,022 1/1974 Wilcox ..... 251/212

*Primary Examiner*—George T. Hall

*Attorney, Agent, or Firm*—Daniel J. Hanlon, Jr.; William D. Herrick; Raymond J. Miller

[57] ABSTRACT

A cover for a tank, hatch, or like container having an opening, including two rims about the perimeter of the opening connected by a flexible sleeve. At least one rim is rotatable with respect to the other, and, when rotated, causes the sleeve to close in an iris fashion and seal the opening. Reversing the rotation untwists the sleeve and causes the cover to open. The device of the present invention does not require sliding plates, cams or gears and is adaptable to closing about a pipe or other obstruction placed in the opening.

5 Claims, 4 Drawing Figures

FLEXIBLE HATCH COVER

BACKGROUND OF THE INVENTION

1. Field of the Invention

The present invention relates to means for closing openings in hatches, tanks, or other containers. In some applications it is desired to close such an opening while maintaining access by means of a temporarily installed pipe or other obstruction extending through the opening. This invention is concerned with closures not only for unobstructed openings, but for openings that must receive such obstructions as well.

2. Description of the Prior Art

Closures which operate in a rotary or twisting manner are well-known. The familiar snap camera usually operates in this manner to adjust the amount of light admitted, for example. Other "iris"-type closures are described in the following patents: U.S. Pat. No. 1,992,225 to Wickersham et al. issued Aug. 15, 1933, U.S. Pat. No. 1,999,699 to Koch issued Apr. 30, 1935, U.S. Pat. No. 2,037,663 to Lalor issued Apr. 14, 1936, U.S. Pat. No. 2,307,273 to Hughes issued Jan. 5, 1943, U.S. Pat. No. 2,649,272 to Barbato issued Aug. 18, 1953, U.S. Pat. No. 3,101,736 Egger issued Aug. 27, 1963, U.S. Pat. No. 3,159,179 to DeLain issued Dec. 1, 1964, U.S. Pat. No. 3,329,396 to Heaton et al issued July 4, 1967, and U.S. Pat No. 3,787,022 to Wilcox issued Jan. 22, 1974. These prior art devices, however, all require the use of hinged plates which slide or swing in and out of a central opening. These cams or plates must be geared mechanically to progressively shut or open a main opening. As such, they suffer the drawbacks of all mechanical devices utilizing a multiplicity of moving parts. furthermore, While, in some cases, they are adapted to closing about an obstruction placed in the opening, the obstruction must be precisely located in the center of the opening to avoid an improper seal about the obstruction. It is, therefore, desirable to produce a closing device of uncomplicated operation requiring a minimum of moving parts and that is adaptable to closing about an obstruction which may not be precisely centrally located within the opening.

SUMMARY OF THE INVENTION

The present invention provides a uniquely adaptable closure for tanks, hatches, or like containers that is uncomplicated in operation and avoids the necessity for sliding metal cams or plates. In accordance with the present invention two rims are placed around the perimeter of the opening and connected to opposite ends of a flexible sleeve. The rims are adapted to rotate with respect to each other by providing means for turning at least one of the rims. This turning action causes the sleeve to twist and close the opening. An obstruction within the opening such as a pipe, or the like, will result in the flexible sleeve forming a tight closure around the obstruction even if the obstruction is not located precisely in the center of the opening. Thus, the present invention provides a particularly advantageous cover avoiding the difficulties and drawbacks of the covers described in the prior art.

DESCRIPTION OF THE PREFERRED EMBODIMENT

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
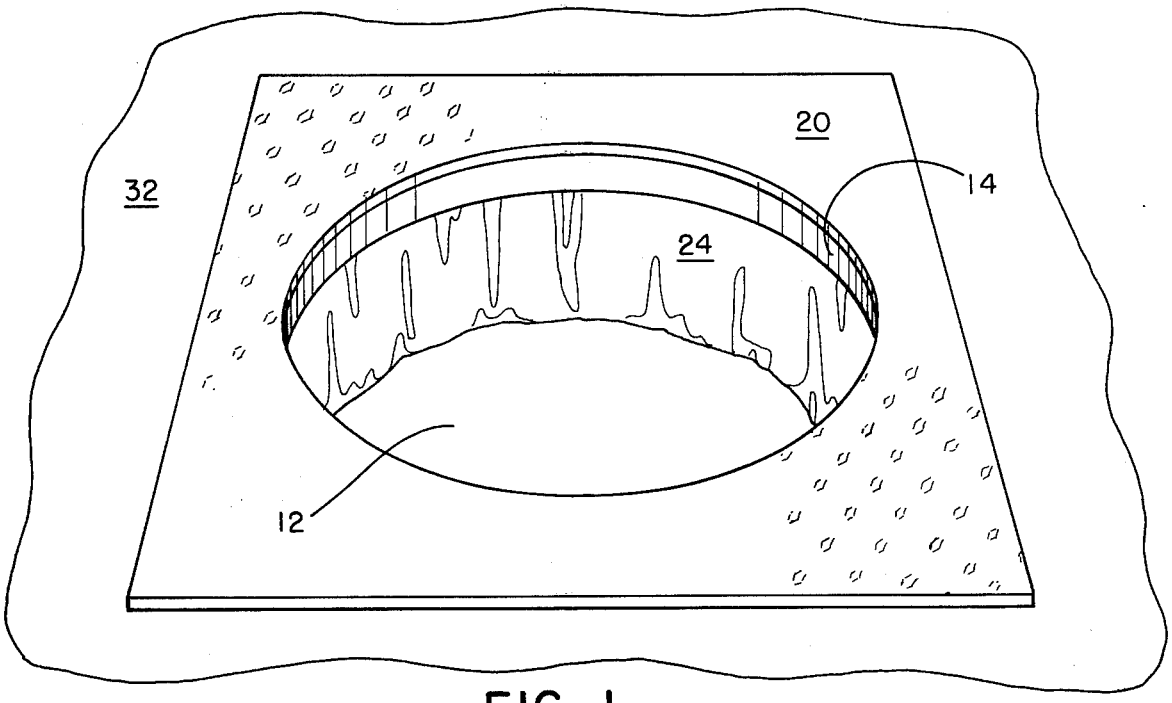
FIG. 1 illustrates the closure of the present invention in an open position.
Figure 2:
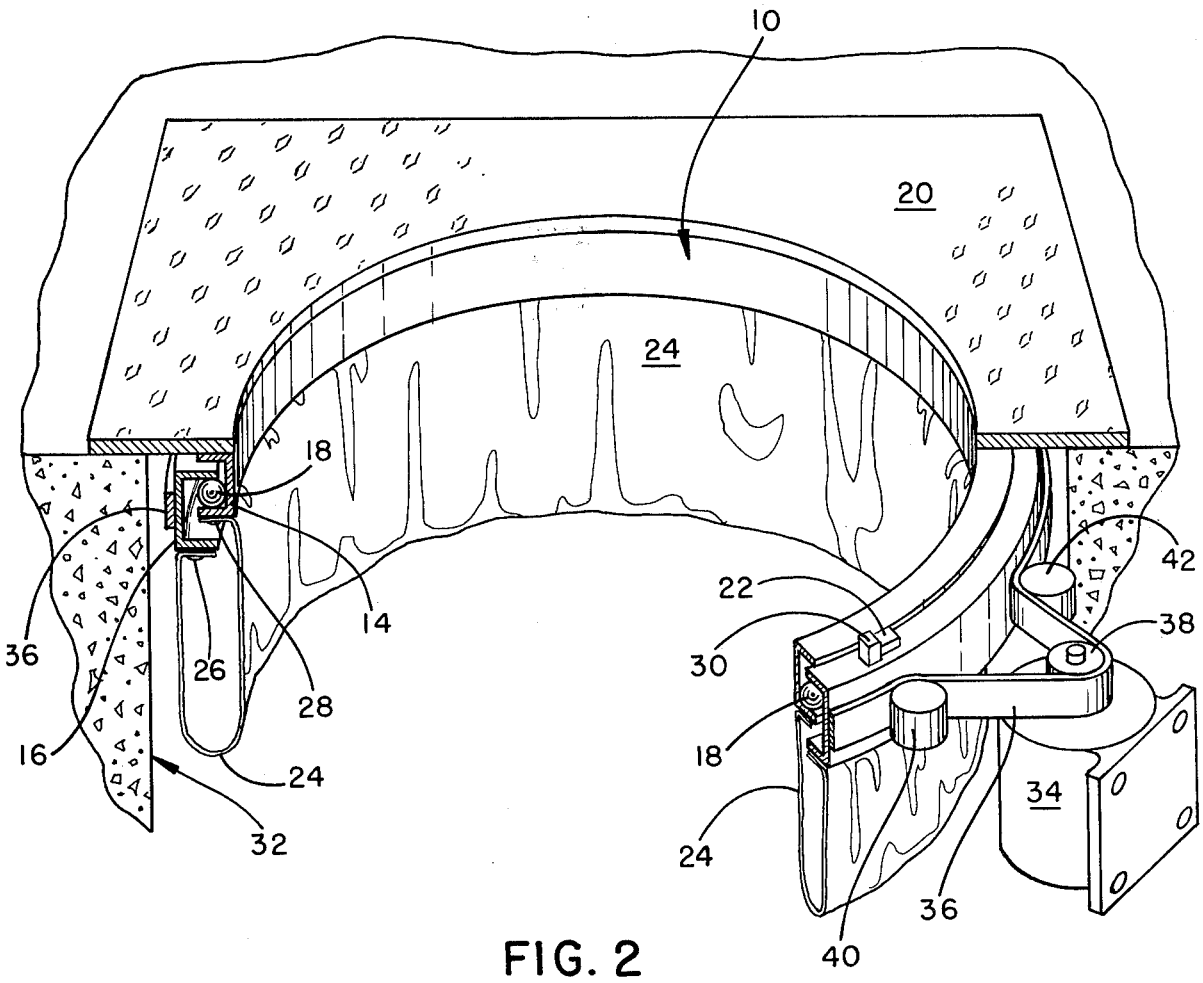
FIG. 2 illustrates the closure of FIG. 1 partially broken away to show a cross section.

Turning now to FIGS. 1 and 2, the invention will be described with reference to a closure for a rotary digester utilized in paper manufacture and illustrated in fragment in the drawings. As the digestion of pulp generates malodorous materials, it is desirable to prevent the escape of these odors prior to scrubbing and discharge to the atmosphere. For this purpose a blow down pipe is utilized and entry to the digester provided through the hatch opening. Therefore, a closure is required which will seal the opening even when the blow down pipe is in use.

In accordance with the invention, a circular ball bearing turn table 10 is utilized having a diameter in accordance with the size of the opening 12. Turntable 10 includes rings 14 and 16 as well as plastic ball bearings 18. Such assemblies are available from turntable bearing manufacturers such as, for example, Rotek, Inc. or may be assembled from available material. Inner bearing ring 14 is permanently attached to supporting diamond plate 20 by means of welds or other fastening means (not shown). The iris sleeve 24 is then attached in place with rivets or other fastening means 26 and 28 with the rings in an opened position. When installing sleeve 24 the stop contacts 22 and 30 should be in position for the open condition. This assembly is bolted in place in the digester 32 shown in fragment.

Sleeve 24 may be made of any close woven material having desirable properties for the use intended. For example, for the rotary digester application, the sleeve should be highly resistant to wear, chemicals, fumes and heat as well as impregnable to air. For example, a polypropylene filter media cloth can be used. Sleeve 24 is preferably constructed in a tubular design with a somewhat smaller diameter inner opening. If complete closure of the opening is desired, the length of the sleeve is preferably at least one-half as long as the longest dimension of the rims. In general there is no upper limit to the length except that bulk and cost of sleeve material would increase with length. In another method of attachment (not shown) stainless steel bands are inserted within hems in the sleeve and attached by means of clamps or other such fasteners. For example, clamps manufactured by Ritz Breeze Inc. under Model No. 4201 may be utilized for this purpose. Separation of rings 14 and 16 is preferably kept at a minimum as illustrated, but they may be separated more widely, if desired, recognizing that it will result in the use of additional sleeve material for complete closure.

The drive system can be any of the types available for producing rotation. As illustrated, air motor 34 drives belt 36 which is held against outer ring 16 by means of tension rolls 40 and 42. Stop contacts are provided for full opened and full closed positions. Motor 34 is preferably adapted to be stopped at any point during the opening or closing operation producing any desired degree of hatch closure.

Figure 3:
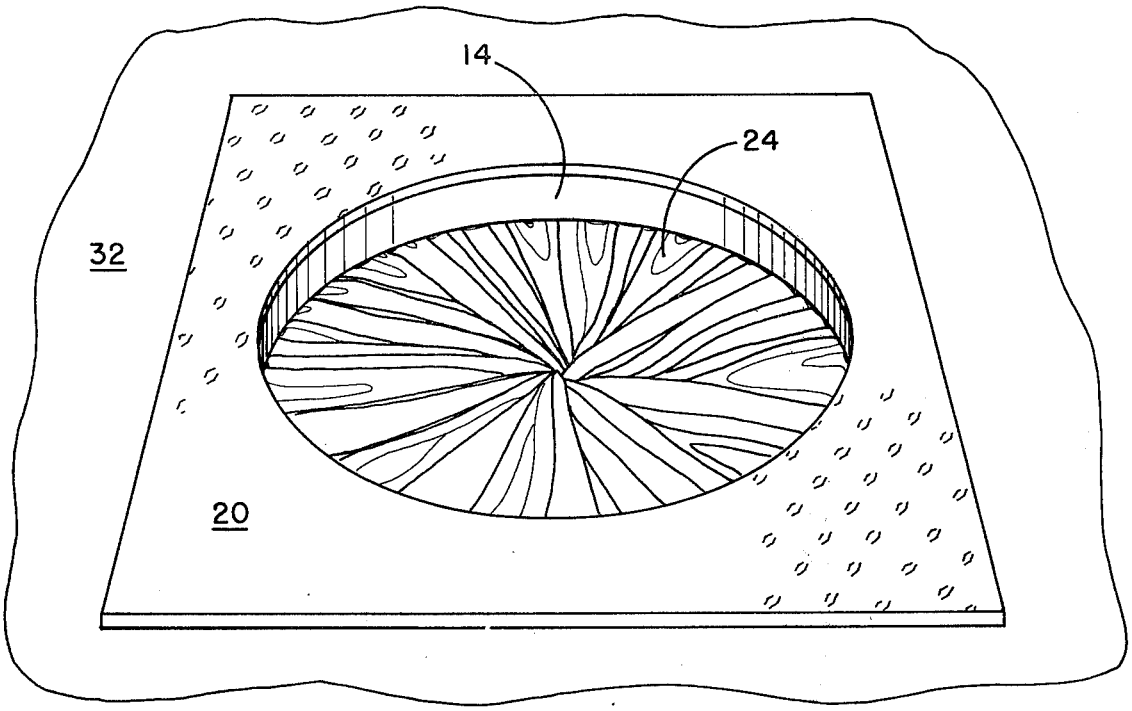
FIG. 3 illustrates the closure of FIG. 1 in a fully closed position.
Figure 4:
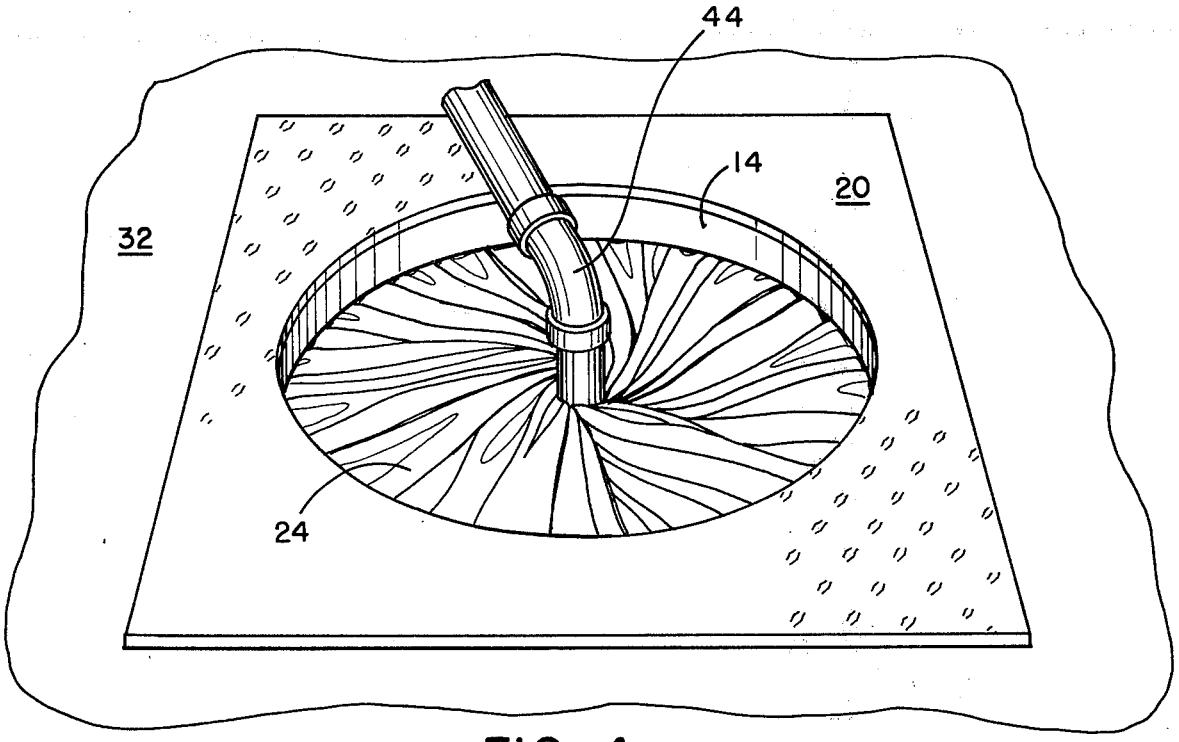
FIG. 4 illustrates the closure of FIG. 1 closed about an obstruction.

In the described application as a closure for a rotary digester, the described cover, when closed, serves to substantially prevent the release of undesirable odors. Turning to FIGS. 3 and 4, the cover of the invention is illustrated in a closed position and in a position closed about blow down pipe 44.

As will be apparent to those skilled in the art, the cover of the present invention will have many applications and is adaptble to the use of varying dimensions and materials of construction. Other applications include valves to shut off or control the flow of materials, covers requiring variable size openings, and covers requiring centrally controlled circular open areas. The advantages of the present invention include the ability to close and open large diameter openings easily at will and seal them with obstructions in the opening. Closures of the present invention can be constructed inexpensively with readily available materials. Also, equipment such as plastic ball bearings and air motors can be utilized requiring no lubrication and giving safety desired for an explosion-proof atmosphere.

Thus, it is apparent that there has been provided, in accordance with the invention, a flexible closure that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

I claim:

1. A flexible hatch cover comprising, a container having an opening, a rim about the circumference of said opening, a second rim about the circumference of said opening and movable in a rotary manner with respect to said first rim, a flexible sleeve having one end attached around the circumference of said first rim and the other end attached around the circumference of said second rim and a length sufficient to at least substantially close the opening, and means for rotating said second rim with respect to said first rim.

2. The cover of claim 1 wherein plastic ball bearings are utilized for rotary movement.

3. The cover of claim 1 wherein said rotating means is an air motor.

4. The cover of claim 1 wherein said flexible sleeve is formed of polypropylene filter media cloth.

5. The cover of claim 1 wherein said flexible sleeve has a length at least equal to one-half the longest dimension of the opening between the rims.

* * * * *